US005711521A

United States Patent [19]

Reist

[11] Patent Number: 5,711,521

[45] Date of Patent: Jan. 27, 1998

[54] CONVEYING APPARATUS FOR PRINTED PRODUCTS

[75] Inventor: Walter Reist, Hinwil, Switzerland

[73] Assignee: Ferag AG, Hinwil, Switzerland

[21] Appl. No.: 687,652

[22] Filed: Jul. 26, 1996

[30] Foreign Application Priority Data

Jul. 27, 1995 [CH] Switzerland ..... 02 206/95-6

[51] Int. Cl.[6] ..... B65H 3/52

[52] U.S. Cl. ..... 271/225; 271/69; 271/184; 271/902

[58] Field of Search ..... 271/225, 902, 271/184, 69; 198/457

[56] References Cited

U.S. PATENT DOCUMENTS

| | | | |
|---|---|---|---|
| 3,224,558 | 12/1965 | Carlen . | |
| 3,735,977 | 5/1973 | Reist . | |
| 4,010,945 | 3/1977 | Kistner | 271/225 |
| 4,071,234 | 1/1978 | Schick . | |
| 4,127,262 | 11/1978 | Erberle et al. . | |
| 4,279,412 | 7/1981 | Glatz . | |
| 4,320,894 | 3/1982 | Reist et al. . | |
| 4,350,330 | 9/1982 | Brown . | |
| 4,595,192 | 6/1986 | Reist | 271/225 |
| 4,645,195 | 2/1987 | Scranton et al. | 271/225 |
| 4,817,933 | 4/1989 | Honjo et al. | 271/225 |
| 5,042,792 | 8/1991 | Honegger et al. . | |
| 5,377,967 | 1/1995 | Eberle . | |
| 5,398,920 | 3/1995 | Leu . | |
| 5,533,720 | 7/1996 | Ahl et al. | 271/184 |

FOREIGN PATENT DOCUMENTS

| | | |
|---|---|---|
| 401933 | 3/1995 | Germany . |
| 62-21666 | 1/1987 | Japan . |

*Primary Examiner*—Karen B. Merritt
*Assistant Examiner*—Douglas A. Hess
*Attorney, Agent, or Firm*—Brinks Hofer Gilson & Lione

[57] ABSTRACT

The conveying apparatus has a feed conveyor which is intended for conveying printed products against a stop. The printed products arrive at the conveying apparatus in an imbricated formation in which each printed product rests on the following printed product. The distance (A) between the stop and the directing member can be changed in time with the arriving printed products, with the result that, when the distance (A) is shortened, the directing member engages beneath the printed product respectively butting against the stop and directs it into the range of action of the removal conveyor.

10 Claims, 4 Drawing Sheets

Fig. 3
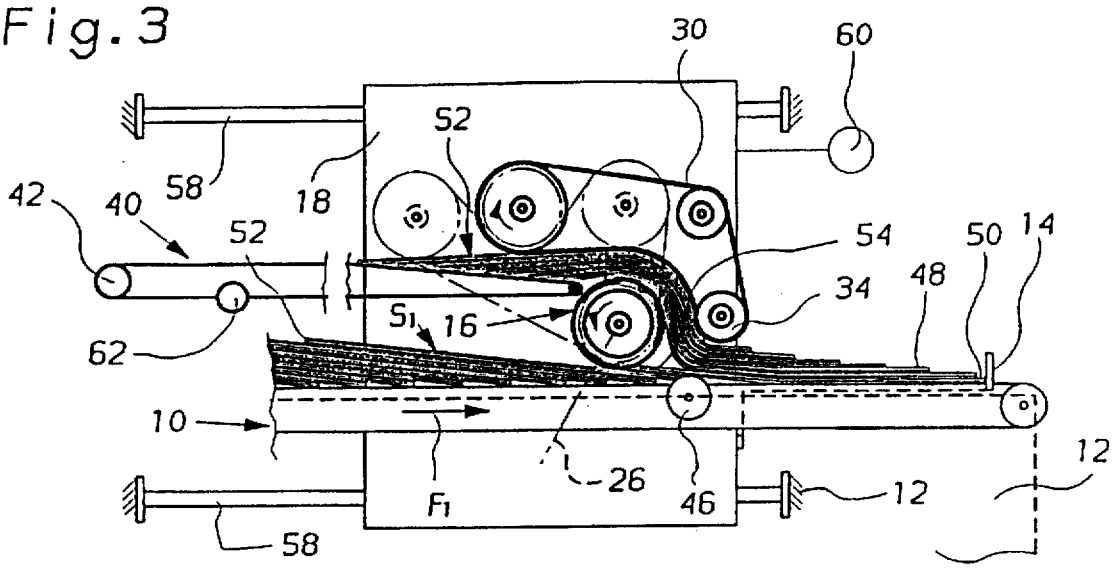
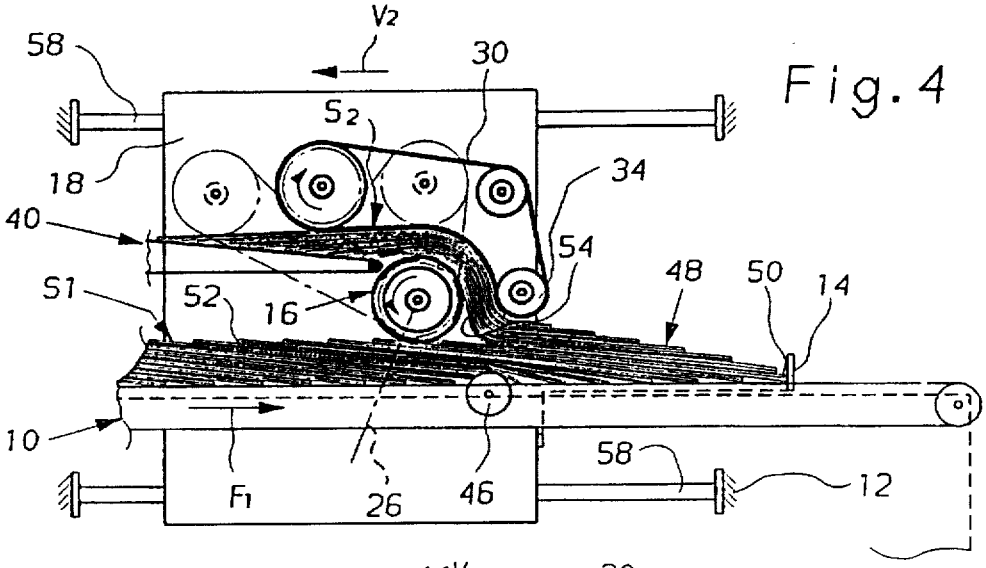
Fig. 4
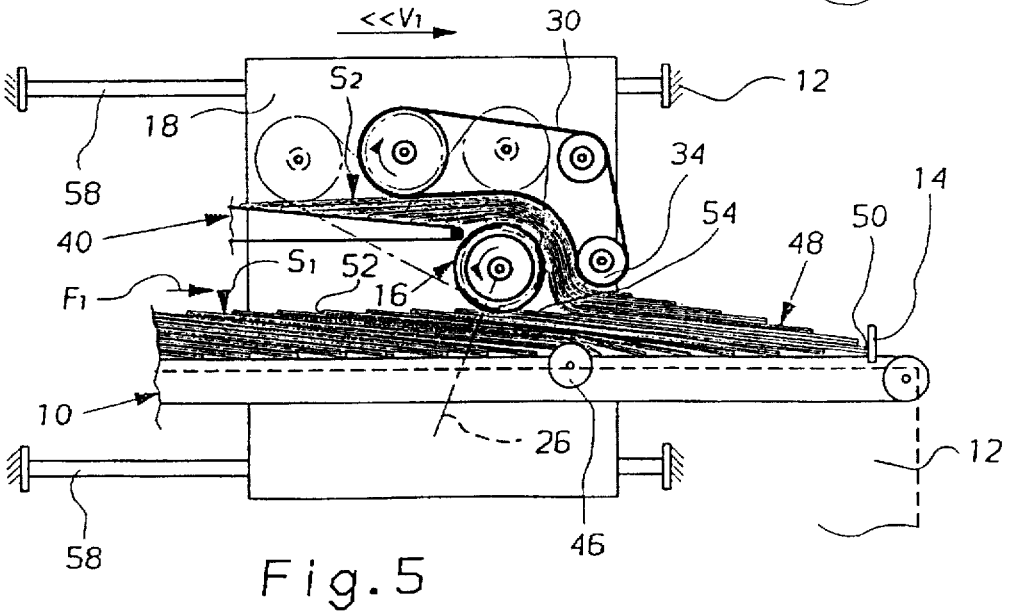
Fig. 5

CONVEYING APPARATUS FOR PRINTED PRODUCTS

BACKGROUND OF THE INVENTION

The present invention relates to a conveying apparatus for, in particular, folded printed products that have a leading edge and a border region that is remote from the leading edge. The conveying apparatus includes a feed conveyor that conveys the printed products in an imbricated formation such that the leading edge contacts a stop. A removal conveyor and directing member are located a distance (A) upstream from the stop. The directing member function to direct the border region of a printed product that is abutting the stop to the removal conveyor.

A conveying apparatus of this general type is disclosed in Austrian Patent Specification No. 240 266. This prior art device includes a feed conveyor that is designed as a belt conveyor and a removal conveyor that is likewise designed as a belt conveyor. The removal conveyor is located at a lower level than the feed conveyor and is driven in the opposite direction. The printed products, arrive at the feed conveyor in an imbricated formation in which each printed product rests on the preceding one and are fed to the removal conveyor at the end of the feed conveyor by said printed products being conveyed, by means of their leading edge, as seen in the conveying direction. When a printed product reaches the end of the feed conveyor it abuts against a stop that is secured to the removal conveyor. The printed product is directed to the removal conveyor by means of a brush roller which is arranged at the end of the feed conveyor. The brush roller acts through friction on the trailing edge of the printed product. The distance between the stop and the brush roller is constant and less than the dimension of the printed products measured from the leading edge to the trailing edge.

In printing works and establishments which process printed products, there are situations in which the printed products arrive for further processing in an imbricated formation in which each printed product rests on the following printed product and a specific edge, for example the folded edge, is trailing, however the further-processing station requires that this specific edge be leading. A further-processing station of this type is disclosed, for example, in U.S. Pat. No. 4,320,894. The conveying apparatus disclosed in Austrian Patent Specification No. 240 266 is not suitable for processing printed products that arrive in such an imbricated formation.

U.S. Pat. No. 5,398,920 further disclose a conveying apparatus which is suitable for processing printed products which arrive in an imbricated formation in which each printed product rests on the following printed product. The printed products are, in this arrangement, conveyed against a stationary stop by means of the feed conveyor. The printed products are pushed downwards one after the other into an intermediate stack. The respectively uppermost printed product of the intermediate stack is gripped by a vacuum arrangement which causes the uppermost printed product to move, counter to the conveying direction of the feed conveyor, into the conveying region of the removal conveyor. A stationary, tongue-like directing member deflects the now leading edge of the printed product into the inlet of the conveying nip of the removal conveyor. This prior art conveying apparatus is used, in particular, for processing printed products that arrive in imbricated formation of different qualities, i.e. with widely varying distances between mutually corresponding edges. This prior art device then feeds the printed products to a further-processing station at the timing required by the latter. The timing of the removal operation is thus separate from the timing of the feed operation.

SUMMARY OF THE INVENTION

It is an object of the present invention to develop a conveying apparatus of the type that it is suitable for processing printed products arriving in an imbricated formation in which each printed product rests on the following printed product.

This object is achieved by an apparatus in which the removal conveyor and the directing member are arranged above the feed conveyor. The distance (A) between the stop and a point on the directing member diminishes in approximate timing with the arriving printed products. The distance (A) varies from a magnitude which corresponds to the dimension of the printed product, measured in the conveying direction, to a smaller dimension. The directing member engages beneath the printed product that is abutting the stop.

According to the invention, the distance between the stop and the directing member is changed at least approximately in time with the arriving printed products. The timing at which the printed products are directed to the removal conveyor is thus linked with the timing at which the printed products arrive at the stop; and the formation of an intermediate stack is not necessary. The construction of the conveying apparatus is straightforward and compact.

BRIEF DESCRIPTION OF THE DRAWINGS

The present invention will now be explained in more detail with reference to exemplary embodiments represented in the drawing:

FIG. 3 is an elevation view, at a point in time, of another embodiment of the inventive conveying apparatus that is suitable for closing gaps in the arriving imbricated formation or for forming gaps in the formation which is to be removed.

FIGS. 4 is an elevation view, of the embodiment shown in FIG. 3 at another point in time.

FIGS. 5 is an elevation view, of the embodiment shown in FIG. 3 at another point in time.

DESCRIPTION OF THE PREFERRED EMBODIMENT

Figure 1:
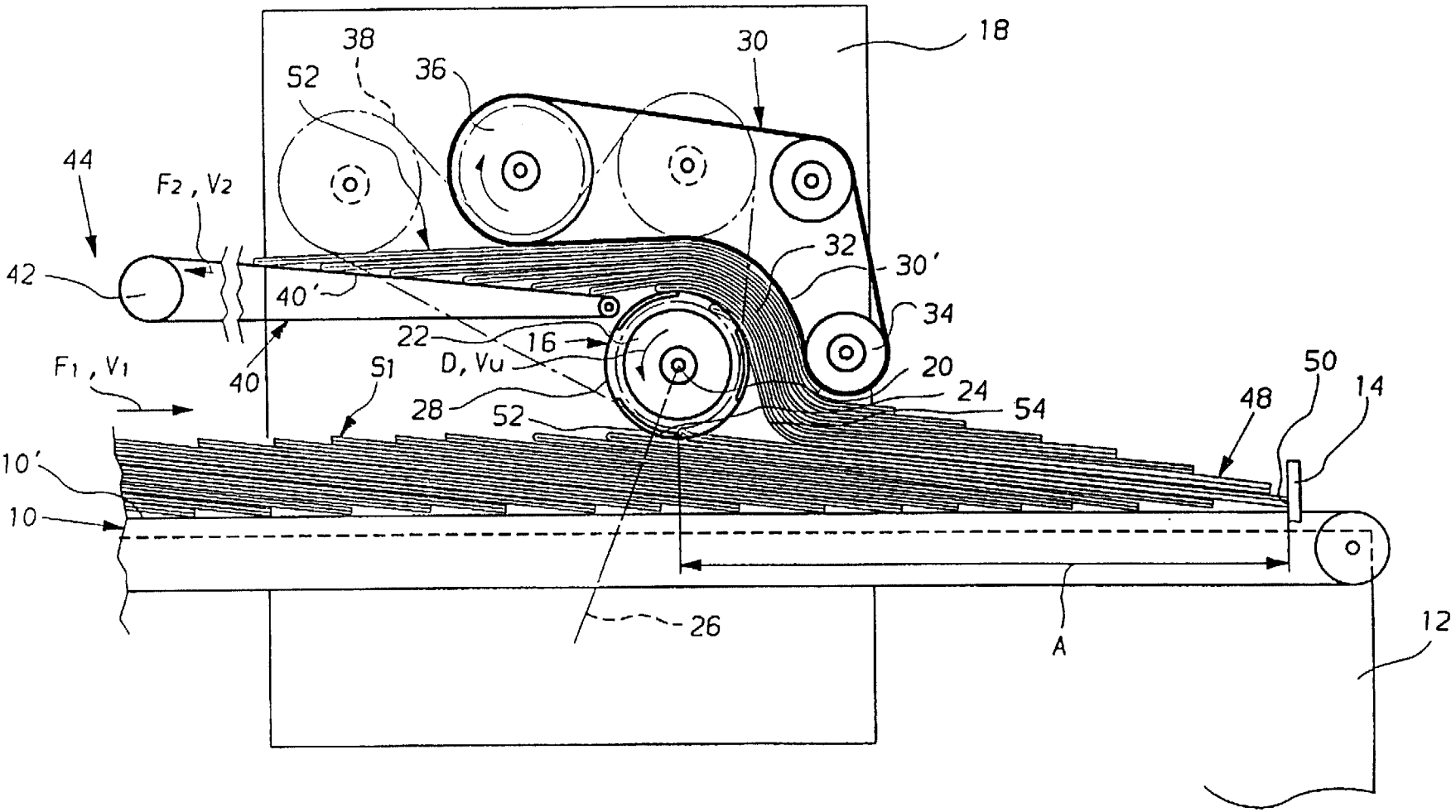
FIG. 1 is an elevation view of a first embodiment of the inventive conveying apparatus having a stationary stop and a directing member with lifting elements arranged around a rotary axis.
Figure 2:
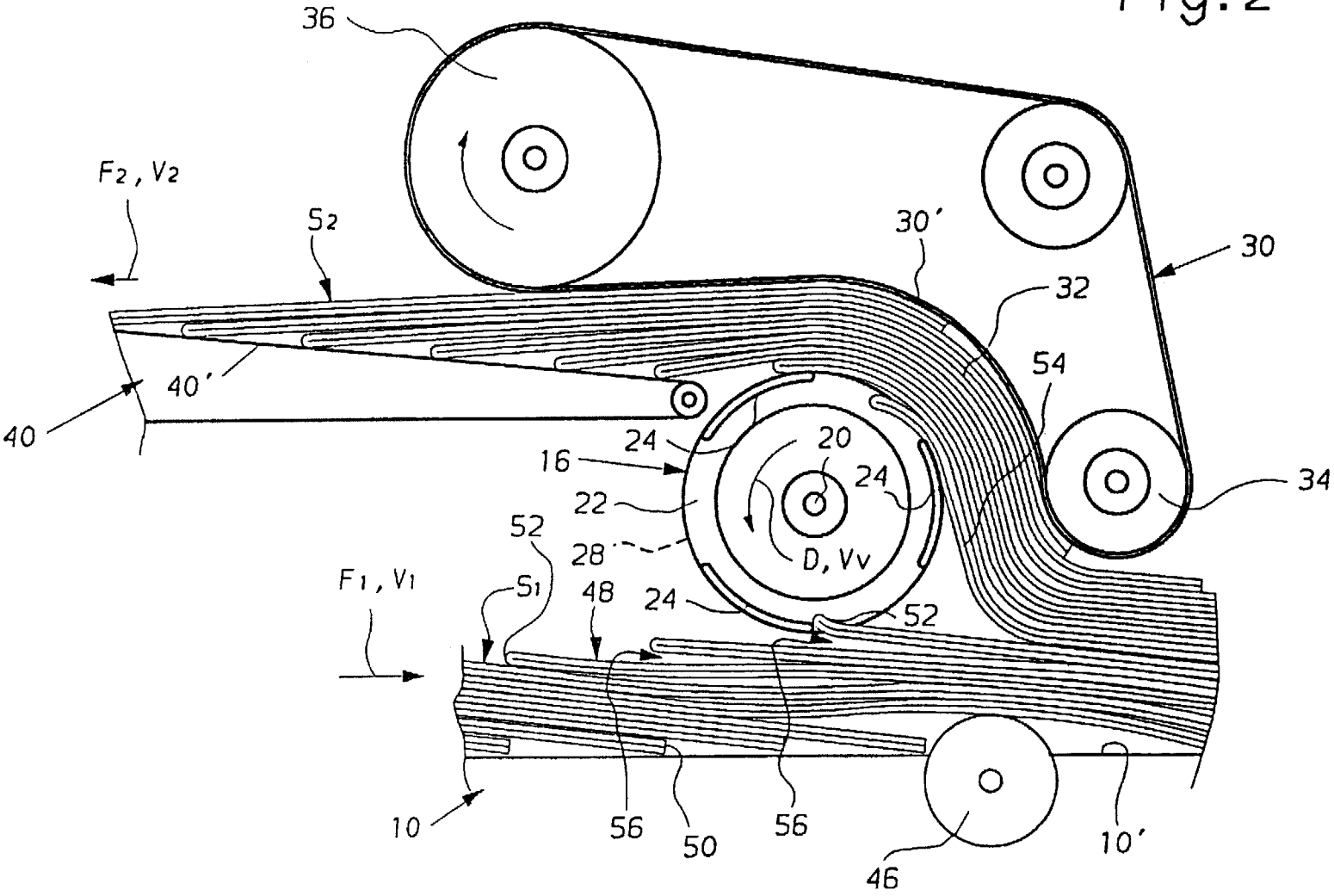
FIG. 2 is an enlarged view, with respect to FIG. 1, of a part of the conveying apparatus.

The conveying apparatus shown in FIGS. 1 and 2 has a feed conveyor 10 which is designed as a belt conveyor and is driven in the conveying direction $F_1$ at the speed $v_1$. Arranged in a stationary manner adjacent to the end of the feed conveyor 10, on a machine framework 12, is a stop 14 which projects into the conveying path of the feed conveyor 10.

Upstream of the stop 14, as seen in the conveying direction $F_1$, and above the essentially horizontal feed conveyor 10, a directing member 16 is mounted, on a panel-like carrier element 18 which is arranged to the side of the feed conveyor 10 and is a part of the machine framework 12. Directing member 16 is rotated about a axis 20 which extends parallel to the conveying plane 10' determined by the feed conveyor 10 and is at right angles with respect to the conveying direction $F_1$. The directing member 16 has a solid-wheel-like mounting element 22 which, with respect to the feed conveyor 10, is located to the side and outside of the conveying region. The three web-like lifting elements 24 extend from the mounting element 22 and are distributed uniformly in the circumferential direction thereof such that they are located above the conveying region of feed conveyor 10. The mounting element 22 with the lifting elements 24 resemble a cup or a drum with recesses which run in the axial direction from the free end of the lifting elements 24 to the counting element 22. The recesses are of a width, as measured in the circumferential direction, are approximately equal to the width of the lifting elements 24. As is indicated by the broken line 26, the directing member 16 is connected to a drive and is driven in the direction of rotation D at a circumferential speed $v_u$. The direction of rotation D is selected such that the distance A between the stop 14 and the leading edge of lifting elements 24 decreases as the lifting elements 24 move through the lower half of their circular movement path 28. During this movement, through the lower half of their circular path, at least one component of movement of lifting element 24 is in the conveying direction $F_1$.

An elastomeric pressure-exerting belt 30 interacts with the lifting elements 24 in order to form a conveying nip 32. On the side of the directing member 16 that is closes to stop 14, the pressure-exerting belt 30 is guided around a deflection roller 34. The diameter of roller 34 is smaller than the diameter of the directing member 16 and its rotary spindle is located approximately at the same level as the rotary axis 20. Beyond the first deflection roller 34, the active strand 30' of the pressure-exerting belt 30 extends over the top of the directing member 16 at an angle of approximately 90° and then extends, approximately parallel to the conveying plane 10', to a second deflection roller 36. A chain drive 38, which is indicated by broken lines, connects the directing member 16 to the second deflection roller 36 and thus to the pressure-exerting belt 30. A slip clutch or a friction bearing is preferably provided between the chain drive 38 and the pressure-exerting belt 30. The slip clutch attempts to drive the pressure-exerting belt 30 at a greater velocity than it is being circulated as a result of the friction with the printed products. As a result buckling of the elastomeric pressure-exerting belt 30 in the section of the active strand 30' between the directing member 16 and the deflection roller 36 is avoided. It is also contemplated that the pressure-exerting belt 30 could circulate freely rather than being driven.

Counter to the conveying direction $F_1$, the directing member 16 is adjoined by a removal conveyor 40 which is likewise designed as a belt conveyor and is driven, counter to the conveying direction $F_1$, in the direction $F_2$. An imaginary extension of the upper active strand 40' of said removal conveyor 40 extends above the rotary axis 20 and beneath the highest point of the movement path 28 of the lifting elements 24. A further-processing station 44, which is indicated by an arrow, is arranged at the end 42 of the removal conveyor 40. The conveying speed $v_2$ of the removal conveyor 40 corresponds at least approximately to that ($v_1$) of the feed conveyor 10.

In the embodiment illustrated in FIG. 2, a freely rotating roller 46 is mounted on the carrier element 18 between the directing member 16 and the stop 14. More precisely, roller 46 is located between the directing member 16 and the first deflection roller 34, and, in the conveying region of the feed conveyor 10. Also a segment of roller 46 projects above the conveying plane 10'.

The feed conveyor 10 is intended for conveying, in particular, folded printed products 48 in an imbricated formation $S_1$ in which each printed product 48 rests on the following printed product 48, as seen in the conveying direction $F_1$. The respectively leading edge 50, as seen in the conveying direction $F_1$, of the printed products 48 is thus located at the bottom and is overlapped by an intermediate portion of the preceding printed product 48. The trailing edge 52 of the preceding printed product 48 rests on the following printed product 48 and is accessible from above. In the example shown, the trailing edge 52 is the folded edge and the leading edge 50 is the cut edge. As seen in the conveying direction $F_1$, the relative position of the directing member 16 with respect to the stop 14 is selected such that the trailing edge 52 of the printed product 48 is located approximately vertically beneath the rotary axis 20 and its leading edge 50 is butting against the stop 14. The distance of the directing member 16 from the conveying plane 10 is such that a lifting element 24 can engage beneath the trailing edge 52 of a printed product 48 the leading edge of which is butting against the stop and, as rotation continues, a border region 54 adjoining the edge 52 is lifted and is moved into the conveying nip 32.

A roller 46, is shown in FIG. 2, that functions to bend the printed products 48, such that a gap 56 opens between the border region 54 of the printed product 48 that abuts against the stop 14 and the following printed product 48. In the embodiment shown in FIG. 2, the distance between the conveying plane 10 and the directing member 16 may be selected to be somewhat greater than if there is no roller 46 present. In other embodiments of the invention the gap can be formed by other means, for example a suction arrangement acting on the printed product.

The printed products 48 are arranged in the imbricated formation $S_1$ such that the distance between the trailing edges 52 of successive printed products 48 is at least approximately equal. This distance, between successive trailing edges, in conjunction with the conveying speed $v_1$, determines the timing at which the printed products 48 arrive. The rotating speed of directing member 16 is coordinated with the arrival time of the printed products 48, with the result that in each case one lifting element 24 acts on each printed product 48.

The mode of functioning of the conveying apparatus shown in FIGS. 1 and 2 is as follows. The feed conveyor 10 conveys the printed products 48 in the conveying direction $F_1$ such that they butt against the stop 14 one after the other. The distance A is reduced, as a result of the leading edge 50 of a printed product 48 against the stop 14 and the relevant lifting element 24 engaging beneath its trailing edge 52. As the directing member 16 continues to rotate, the work product 48 is bent in the upwards direction along its border region 54 and moved into the conveying nip 32. The printed product 48 that is retained in the conveying nip 32 between the relevant lifting element 24 and the pressure-exerting belt 30 is drawn away from the stop 14 in the direction $F_2$ which is counter to the conveying direction $F_1$. The work product 48 then moves into the range of action of the removal conveyor 40. The border region 54 of the respectively following printed product 48 is laid against the preceding printed product from beneath, this forming an imbricated formation $S_2$ in which, once again, each printed product 48 rests on the following printed product, but the edge which was previously located at the top and trailing is now located at the bottom and leading. In this imbricated formation $S_2$, the printed products 48 are transported away by the removal conveyor 40.

The embodiment of the conveying apparatus shown in FIGS. 3 to 5 is similar to the embodiment shown in FIGS. 1 and 2, with the exception that the stop 14 is fastened on the carrier element 18 which can be moved. In this embodiment the carrier element 18 moves, in the manner of a carriage, by means of a drive 60 along guide rails 58 in and counter to the conveying direction $F_1$. Since deflection roller 34, of the removal conveyor 40, is also mounted on the carrier element 18, the length of the conveying section of the removal conveyor 40 changes when the carrier element 18 moves. The roller arranged at the end 42 is mounted in a stationary manner. This change in length is compensated for by a length-compensating device 62 in the return strand. Since the stop 14 moves together with the carrier element 18, the length of the conveying section of the feed conveyor 10 also changes in the same direction as that of the removal conveyor 40.

That embodiment of the conveying apparatus which is shown in FIGS. 3 to 5 operates as follows. If there are no gaps in the incoming imbricated formation $S_1$, i.e. no printed products 48 are missing from said formation, the printed products 48 are processed while the carrier element 18 is at a standstill in precisely the same manner as has been described above in connection with FIGS. 1 and 2. If, however, there is a gap in the imbricated formation $S_1$, i.e. one or more printed products 48 are missing from said formation, as shown in FIG. 3, this is detected by a detector (not shown), which results in the directing member 16 being brought to a standstill as soon as the printed product 48 directly preceding the gap butts against the stop 14 and has the relevant lifting element 24 engaged beneath it. At the same time, the carrier element 18 is then displaced, by the drive 60, counter to the conveying direction $F_1$ at the speed $v_2$ of the removal conveyor 40, to be precise until the printed product 48 directly following the gap butts against the stop 14, FIG. 4. At this point in time, the drive 60 is stopped and the carrier element 18 is brought to a standstill and the directing member 16 is once again driven in time with the arriving printed products 48. As can be seen in FIGS. 4 and 5, the gap has been closed and there is thus no longer a gap in the imbricated formation $S_2$. The carrier element 18 may then be moved back in the conveying direction $F_1$ into the initial position, by means of the drive 60, at a speed which is considerably lower than the conveying speed $v_1$, as is indicated in FIG. 5.

The embodiment shown in FIGS. 3 to 5, can also function to form gaps in the imbricated stream. If it is desired to create a gap, the directing member 16 is brought to a standstill and the carrier element 18 is moved in the conveying direction $F_1$ at the speed $v_1$ until the desired gap size has been achieved. The carrier element 18 is then brought to a standstill and the directing member 16 is driven once again in time with the arriving printed products 48.

Figure 6:
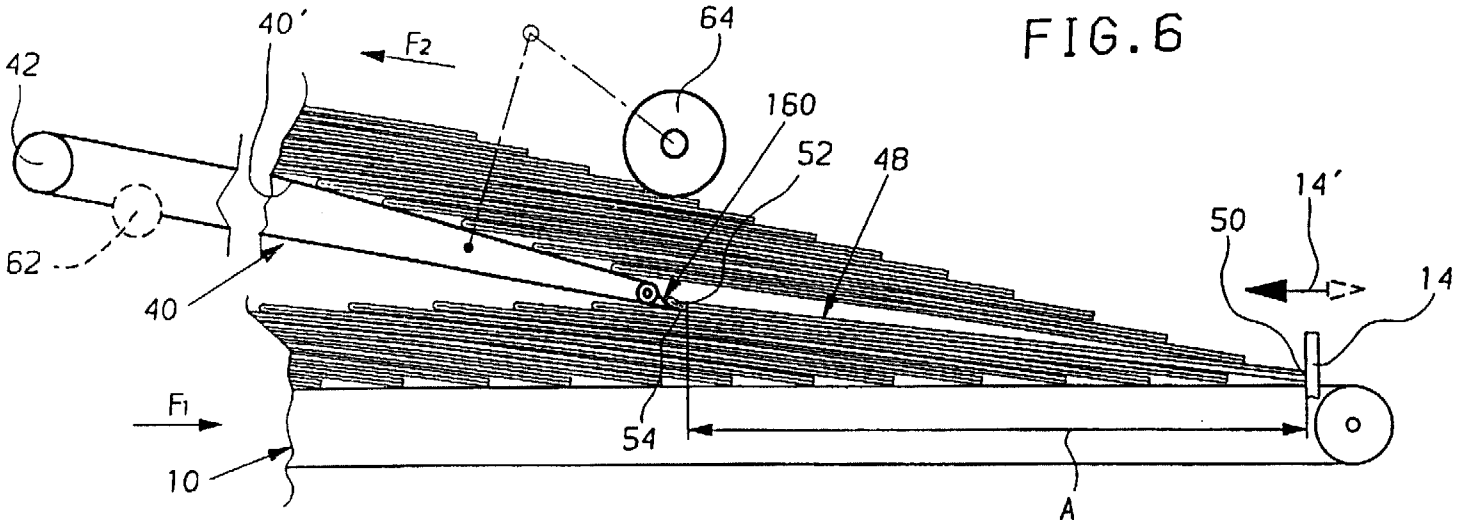
FIG. 6 is an elevation view of a further embodiment of the inventive conveying apparatus having a stop which moves back and forth and a stationary directing member.
Figure 7:
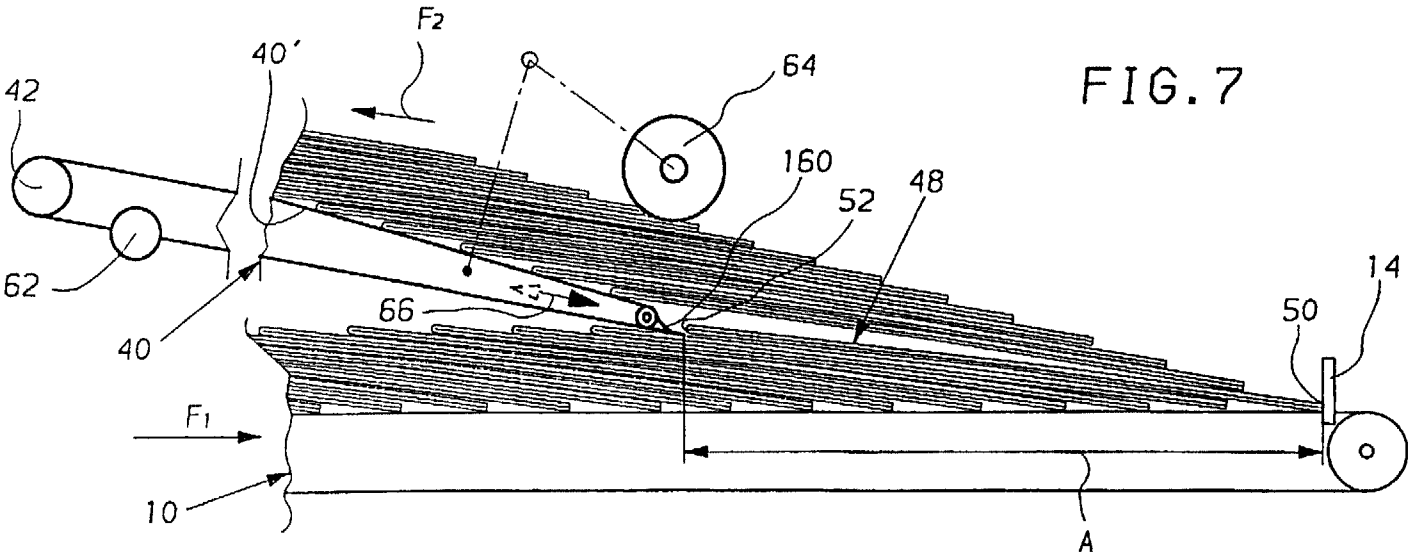
FIG. 7 is an elevation view of an embodiment of the inventive conveying apparatus, which is similar to the conveying apparatus shown in FIG. 6, however in this embodiment the stop is stationary and the directing member is driven such that it moves back and forth.

The embodiment of the invention shown in FIGS. 6 and 7 likewise has a feed conveyor 10 which is designed as a belt conveyor and is driven in the conveying direction $F_1$ at the conveying speed $v_1$. Provided at the end region of the feed conveyor 10 is a stop 14 which projects into the conveying path. The removal conveyor 40, arranged above the feed conveyor 10, is likewise designed as a belt conveyor and is driven in the counter circulation direction to the conveying direction $F_1$ in the direction $F_2$. The removal conveyor includes a directing member 160 which is in the form of a tongue and, as seen in the conveying direction $F_2$, is arranged directly upstream of the conveying belt 40. A pressure roller 64 interacts with the printed product 48 in the region at the beginning of the removal conveyor 40. The distance between the stop 14 and the free end of the directing member 160 which faces said stop is designated by A. With respect to the conveying direction $F_1$, said directing member 160 is located upstream of the stop 14.

As is indicated in FIG. 6 by the double arrow 14', the stop 14 is driven such that it moves back and forth in time with the arriving printed products 48 in and counter to the conveying direction $F_1$. The distance A being at least equal to, but preferably somewhat greater than, the dimension of the printed products 48 measured in the conveying direction $F_1$ when the stop 14 is located, in the direction of the dashed arrow, in its end position with the distance A at a maximum. In this end position, of stop 14, which is indicated by the solid arrow and where the distance A is at a minimum, said distance is smaller than the dimension of the printed products 48. The removal conveyor 40 and thus the directing member 160 are arranged in a stationary manner.

In the embodiment shown in FIG. 7, the stop 14 is arranged in a fixed manner, whereas the tongue-like directing member 160, together with the adjacent deflection roller, of the removal conveyor 40, are driven such that they can be moved back and forth in the direction of the double arrow 66. The tongue-like directing member 160 and the adjacent deflector rotor move in time with the arriving printed products 48. In that end position, which is indicated by the dashed arrow and, where the distance A is at a maximum, said distance corresponds at least to the dimension of the printed products 48 measured in the conveying direction $F_1$. The distance A is smaller than this dimension when the directing member 160 is located in its end position designated by the solid arrow. A length-compensating device 62, is located in the return strand of the removal conveyor 40, for compensating for the change in length of the conveying section of the removal conveyor 40.

The feed conveyors 10 shown in FIGS. 6 and 7 are also intended for conveying printed products 48 in an imbricated formation $S_1$ in which each printed product rests on the following printed product, as seen in the conveying direction $F_1$. Here too, the leading edge 50 is overlapped by the preceding printed product 48, the trailing edge 52 rests on the following printed product 48 and is accessible from above. The movement back and forth of the stop 14 or of the directing member 160 is synchronized with the timing of the arriving printed products 48 such that the foremost printed product 48 of the imbricated formation $S_1$ butts, by means of its leading edge 50, against the stop 14 when the distance A is at a maximum. The subsequent reduction in this distance A means that the printed product 48 butting against the stop 14 is pushed, counter to the conveying direction $F_1$, onto the directing member 160 in its border region 54. The previously trailing edge 52 now becoming the leading edge (FIG. 6). The free end of directing member 160 is inserted, between the printed product 48 butting against the stop 14 and the printed product following that is butting against the stop 14. Consequently, the border region 54, of the printed product is directed to the removal conveyor 40. The printed products 48 are then removed, in an imbricated formation $S_2$ in which, once again, each printed product 48 rests on the following printed product, but the edge 52 which was previously located at the top and trailing is now located at the bottom and leading. For the sake of completeness, it should be mentioned that the deflection roller at the end 42 of the removal conveyor 40 is driven, with the result that the movement back and forth of the directing member 160 and the adjacent deflection roller does not influence the removal of the printed products 48.

An embodiment of the invention is also contemplated in which the stop 14 and the directing member 16 are both moved in time with the arriving printed products, equally and in opposite directions, towards one another and away from one another. This embodiment also includes a length-compensating device 62, as is indicated by dashed lines in FIG. 6.

Furthermore, the tongue-like directing member 16 could also be arranged in a pivotable manner, with the result that its free end always rests on the printed products 48.

It should be noted that the distance between the directing member 16, in the embodiments shown in FIGS. 1 to 5 and in FIGS. 6 and 7, and the conveying plane 10' could be adjustable so that it is possible to process printed products 48 of different thicknesses.

I claim:

1. A conveying apparatus for folded printed products that include a leading edge and a border region that is remote from said leading edge, said conveying apparatus includes a feed conveyor for conveying the printed products, leading edge first, in an imbricated formation against a stop, a removal conveyor, and a directing member, said directing member is arranged at a distance (A) upstream with respect to said stop and functions to direct said border region of the printed product to the removal conveyor, wherein:

the printed products arrive in an imbricated formation in which each printed product rests on the following printed product;

the removal conveyor and the directing member are independent of each other and are each arranged above said feed conveyor;

the distance (A) between said stop and a point on said directing member is shortened, at approximately the same time that the leading edge of an arriving printed product abuts said stop, from a magnitude which corresponds at least to the dimension of the printed products measured in the conveying direction to a magnitude which is smaller than said dimension; and as a result of the distance (A) being shortened, said directing member engages the lower surface of the border region of the printed product that is butting against said stop.

2. The conveying apparatus as claimed in claim 1, wherein the directing member is driven in order to change the distance (A) between the stop and the directing member.

3. The conveying apparatus as claimed in claim 2, wherein the stop is driven in order to change the distance (A) between said stop and said directing member.

4. The conveying apparatus as claimed in claim 1, wherein the stop is driven in order to change the distance (A) between said stop and said directing member.

5. The conveying apparatus as claimed in claim 1, wherein the directing member includes a tongue having a free end that is inserted, when the distance (A) is shortened, by means of its free end being oriented in the direction of the stop, between the border regions of the first printed product that is butting against the stop and the printed product following said first printed product.

6. The conveying apparatus as claimed in claim 1, wherein the directing member has a lifting element which is driven in rotation along a closed movement path and on a section of its movement path engages the lower surface of the border region of the printed product that is butting against the stop and bends said printed product in an upwards direction.

7. The conveying apparatus as claimed in claim 6, wherein a plurality of lifting elements are distributed one behind the other in the circumferential direction on a wheel-like mounting element, and the rotary axis of the mounting element extends transversely with respect to the conveying direction and at least approximately parallel to the conveying plane of the feed conveyor.

8. The conveying apparatus as claimed in claim 7, which comprises a pressure-exerting belt which, with the lifting elements, forms a conveying nip for the printed products which are to be directed to the removal conveyor.

9. The conveying apparatus as claimed in claim 1, further including a bending element which includes a roller, located between the directing member and the stop, over which the imbricated formation is conveyed, and which functions to bend the printed products, with the result that a gap for the engagement of the directing member opens in each case between the printed product that is butting against the stop and the following printed product.

10. The conveying apparatus as claimed in claim 1, wherein said stop and said directing member are arranged on a carrier element which is movable in and counter to the conveying direction, and said carrier element is driven, with simultaneous shortening or lengthening of the conveying sections of the feed and removal conveyors, in order to close up gaps in the incoming imbricated formation or to form gaps in the formation which is to be removed.

* * * * *